US006170289B1

(12) United States Patent
Brown et al.

(10) Patent No.: US 6,170,289 B1
(45) Date of Patent: Jan. 9, 2001

(54) NOISE SUPPRESSING REFRIGERATION JUMPER TUBE

(75) Inventors: Paul Kenneth Brown, Louisville, KY (US); Jimmy Alan Dobbs, Decatur, AL (US)

(73) Assignee: General Electric Company, Louisville, KY (US)

( * ) Notice: Under 35 U.S.C. 154(b), the term of this patent shall be extended for 0 days.

(21) Appl. No.: 09/336,497

(22) Filed: Jun. 18, 1999

(51) Int. Cl.[7] ..... F25B 41/06
(52) U.S. Cl. ..... 62/511; 62/296
(58) Field of Search ..... 62/511, 296

(56) References Cited

U.S. PATENT DOCUMENTS 2,933,905 * 4/1960 Simmons ..... 62/511
2,967,410 * 1/1961 Schulze ..... 62/505
3,531,947 * 10/1970 Drury et al. ..... 62/511
3,815,379 * 6/1974 Scherer et al. ..... 62/296
4,086,782 * 5/1978 Forsberg ..... 62/296
4,169,361 * 10/1979 Baldus ..... 62/402
4,381,651 * 5/1983 Kubo et al. ..... 62/296
4,408,467 * 10/1983 Murnane et al. ..... 62/296
4,445,343 * 5/1984 McCarty ..... 62/324.1
4,793,150 * 12/1988 Wattley et al. ..... 62/296

* cited by examiner

*Primary Examiner*—William Doerrler
*Assistant Examiner*—Marc Norman
(74) *Attorney, Agent, or Firm*—H. Neil Houser; George L. Rideout, Jr.

(57) ABSTRACT

A jumper tube for connecting a flow restricting capillary tube and an evaporator in a refrigerator system includes a transition portion in between a cavity portion and a cylindrical portion. The transition portion is crimped and folds a portion of the jumper tube sidewall onto itself to form a passage in the shape of clam shell. The transition portion prevents the creation of popping sounds in the jumper tube due to uncontrolled expansion of refrigerant exiting the capillary tube.

20 Claims, 4 Drawing Sheets

NOISE SUPPRESSING REFRIGERATION JUMPER TUBE

BACKGROUND OF THE INVENTION

This invention relates generally to refrigeration systems and, more particularly, to a noise suppressing jumper tube for connecting a refrigeration condenser and evaporator.

One type of refrigeration system includes, in closed series fluid communication, an evaporator, a compressor, a condenser, a capillary tube, and a jumper tube. The compressor receives a refrigerant from the evaporator and compresses the refrigerant. The compressed refrigerant is supplied to the condenser. Refrigerant flowing out of the condenser enters the capillary tube, which restricts flow of refrigerant from the condenser and maintains a pressure differential between the evaporator and the condenser. The jumper tube connects the capillary tube and the evaporator and provides a transition from the small diameter capillary tube passage and the large diameter passage in the evaporator.

The refrigerant discharged from the capillary tube may be in the form of a liquid, a gas, or a combination of liquid and gas. A portion of the refrigerant vaporizes as it is discharged from the capillary tube into the relatively low pressure environment of the evaporator via the jumper tube. The pressure difference between the refrigerant in the capillary tube and the refrigerant in the evaporator causes liquid refrigerant flowing subsonically through the capillary tube to flow near or above supersonic velocities as it is discharged from the capillary tube and vaporizes. It is believed that the transition between subsonic and supersonic flows and/or the vaporization process, causes a popping noise similar to the sound of a woodpecker pecking on wood (sometimes referred to as woodpecker noise or "WPN") as the refrigerant expands in the jumper tube and in the evaporator.

BRIEF SUMMARY OF THE INVENTION

In an exemplary embodiment of the invention, a jumper tube for a refrigeration system includes a transition portion which facilitates reduction, and possibly even elimination, of woodpecker noise as well as reducing or eliminating refrigerant groaning or rushing noises. Specifically, the jumper tube transition portion includes a crimp which forms a restricted passage and a transition angle from the smallest section of the crimped portion to a cylindrical portion of the tube that is greater than 7° measured from the longitudinal axis of the jumper tube. It is believed that by selecting the transition angle to be greater than 7°, refrigerant can be continuously expanded within the transition portion without generating noise.

The jumper tube also includes a bend section a short distance downstream of the transition portion. The bend section affects flow of refrigerant moving downwardly through the jumper tube when the jumper tube is connected to an evaporator. Also, the downstream end of the bend is inclined upward when the jumper tube is connected to the evaporator, further affecting the behavior of the refrigerant through the jumper tube. It is believed that the combination of the transition angle, the downward flow of the refrigerant through the transition portion, the bend in the cylindrical portion, and the upward flow from the bend into the evaporator tube prevent generation of woodpecker noise in the system.

DETAILED DESCRIPTION OF THE INVENTION

Figure 1:
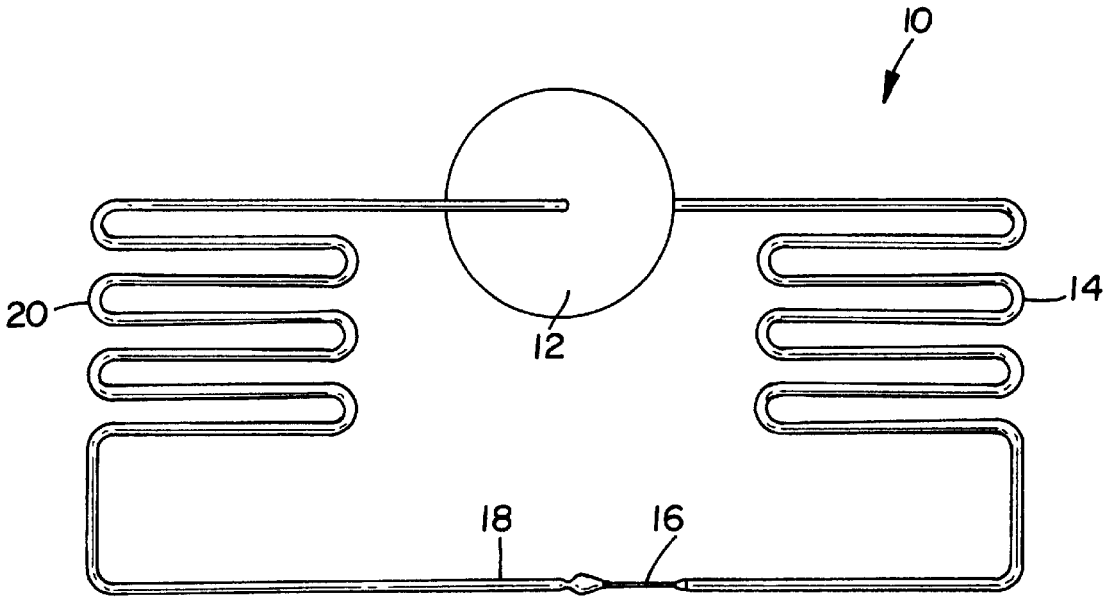
FIG. 1 is a schematic diagram of a refrigeration system including a jumper tube.

FIG. 1 schematically illustrates a refrigeration system 10, or circuit, including a compressor 12, a condenser 14, a flow restrictor, such as a capillary tube 16, a jumper tube 18, and an evaporator 20 connected in closed series flow relationship. Compressor 12 draws refrigerant vapor from evaporator 20 and discharges compressed refrigerant to condenser 14. High pressure refrigerant condensed in condenser 14 flows to evaporator 20 through capillary tube 16 and jumper tube 18.

Capillary tube 16 restricts the flow of liquid refrigerant to evaporator 20 and maintains a pressure differential between condenser 14 and evaporator 20. Specifically, an inner diameter of capillary tube 16 is much smaller than the inner diameter of other fluid passages in system 10. Jumper tube 18 connects the small passage of capillary tube 16 to the larger passage of evaporator 20.

Figure 2:
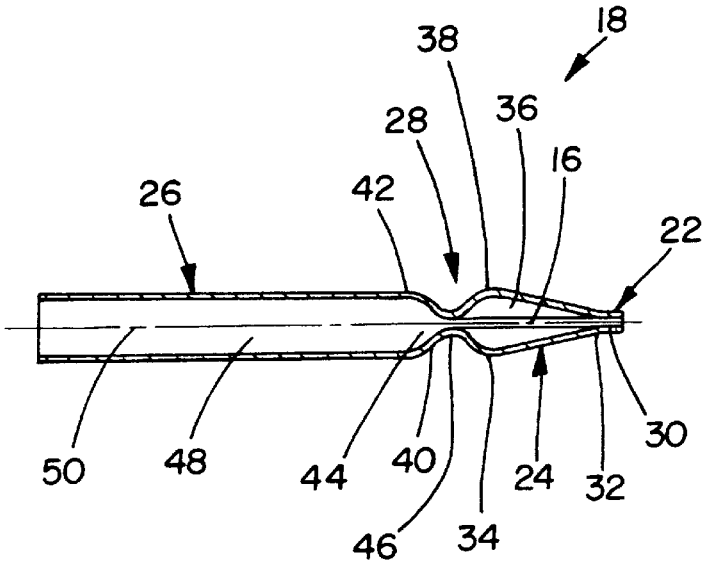
FIG. 2 is an front cross-sectional view of the jumper tube shown in FIG. 1.

FIG. 2 is an enlarged view of jumper tube 18. Jumper tube 18 includes an inlet portion 22, a cavity portion 24, a cylindrical portion 26, and a transition portion 28. Inlet portion 22 has circular cross-sectional shape and an inlet passage 30 having an inner diameter slightly larger than the inner diameter of capillary tube 16. Capillary tube 16 is inserted through inlet portion 22 during use in refrigeration system 10 (FIG. 1). Refrigerant flows from condenser 14 (FIG. 1) in a downstream direction through jumper tube from right to left in FIG. 2, and ultimately to evaporator 20 (FIG. 1).

Cavity portion 24 extends from inlet portion 22 and includes a first end 32, a second end 34, and a passage 36, or cavity, therethrough. Passage 36 increases in size, i.e., the cross sectional area of passage 36 increases, from cavity portion first end 32 to cavity portion second end 34. Thus, passage 36 forms an expanded area or cavity around capillary tube 16 for deposit of material produced by brazing, soldering, or other joining methods that can be used to form a leakproof connection between capillary tube 16 and cavity portion 24. Also, capillary tube 16 extends through cavity portion 24 to prevent materials from clogging capillary tube 16. While cavity portion 24 as illustrated has a substantially conical shaped deposit cavity, in alternative embodiments the deposit cavity could have many other shapes without adversely affecting WPN suppression and still serve the functional purpose of containing capillary tube attachment byproducts and preventing capillary tube 16 from being clogged.

Transition portion 28 extends from cavity portion second end 34 and includes a first end 38, a crimped portion 40, a second end 42, and a transition passage 44 therethrough. Crimped portion 40 is formed with a crimper, either by hand or with a machine, and has an hour glass shape. Transition passage 44 decreases in cross sectional area to a section 46 where transition passage 44 has a cross-sectional area smaller than inlet passage 30. On either side of section 46, transition passage 44 has a larger cross sectional area. Transition passage 44 continuously increases, i.e., not a step increase, in cross sectional area at transition portion second end to a cylindrical passage 48 of cylindrical portion 26 extending from transition portion second end 42. Cylindrical portion 26 is dimensioned for connection to evaporator 20 (FIG. 1), and includes a longitudinal axis 50 which also extends through inlet portion 22, cavity portion 24 and transition portion 28. In alternative embodiments, one or more of inlet portion 22, cavity portion 24, and transition portion 28 are offset from longitudinal axis 50 of cylindrical portion 26.

When connected to system 10 (FIG. 1), transition portion 28 forms a stop for capillary tube 16 which is inserted through inlet portion 22 and cavity portion 24. The shape of transition passage 44 also facilitates preventing WPN when refrigerant flows through jumper tube 18, and crimped portion 24 supports capillary tube 16 and prevents vibration of capillary tube 16. However, it has been observed that WPN is also suppressed in alternative embodiments where capillary tube is not supported by crimped portion 40.

Unlike known jumper tubes, jumper tube 18 has a maximum transition angle in the flow path of refrigerant measured from longitudinal axis 50 between section 46 and second end 42 of crimped portion 40 (i.e., the angle at which an imaginary line tangential to the greatest sloped segment of the crimped portion 40 would intersect the longitudinal axis 50) greater than 7°. Typically, the maximum transition angle is selected from the range of 20° to 49°, and more typically, from the range of 34° to 39°.

Figure 3:
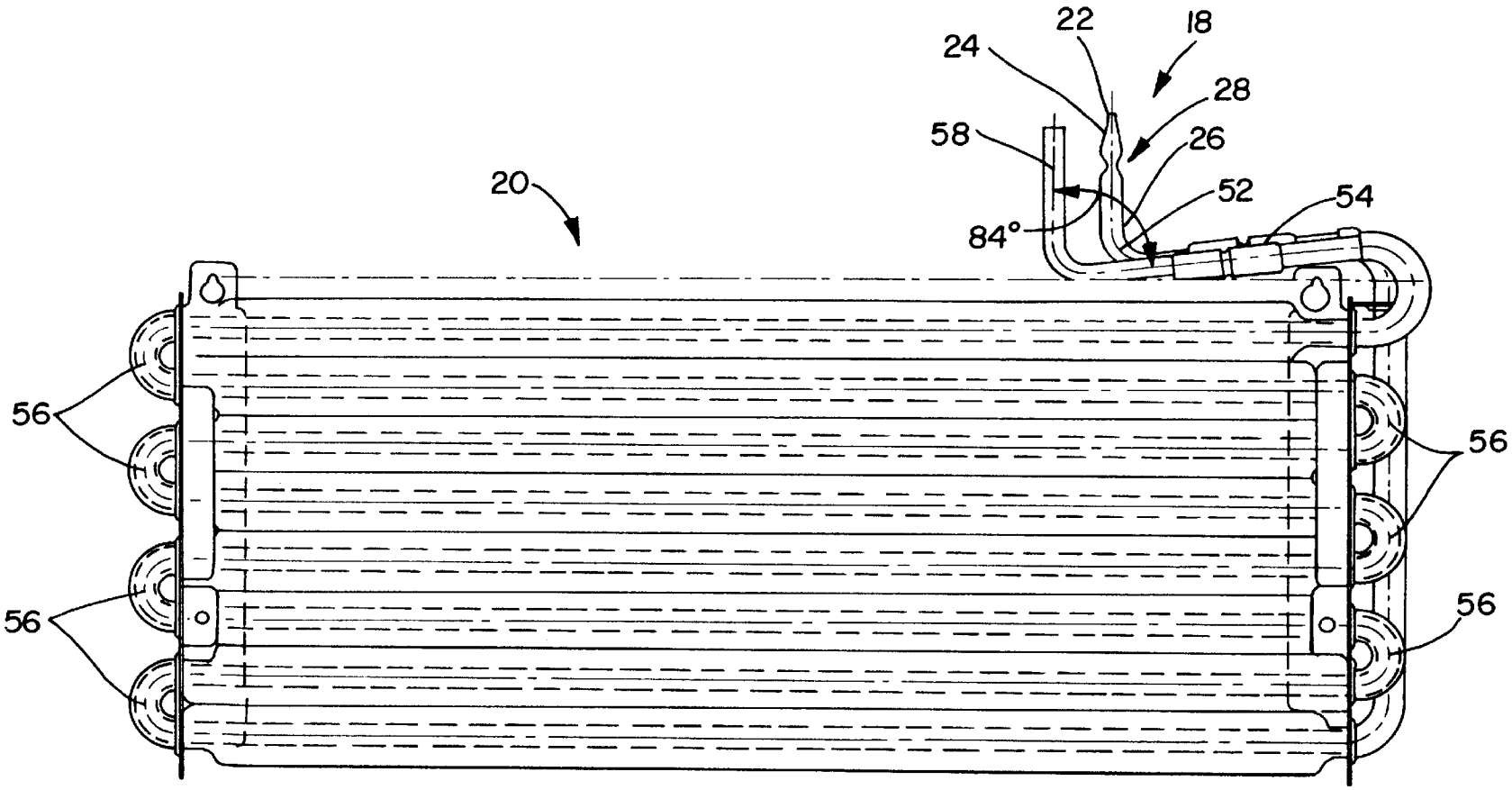
FIG. 3 is a top plan view of a refrigerator evaporator connected to the jumper tube shown in FIG. 2.

FIG. 3 illustrates the connection of jumper tube 18 to evaporator 20. Jumper tube inlet portion 22, cavity portion 24 and transition portion 28 are positioned above an evaporator inlet 54. A bend section 52, such as the 84° bend shown, in cylindrical portion 26 is located a short distance, for example, about 1.5 inches from transition portion 28, and results in refrigerant flowing through jumper tube 18 to be flowing upward at a 6° angle relative to evaporator 20 immediately after bend section 52. Bend section 52 therefore affects the propagation of refrigerant through jumper tube 18 and is believed to facilitate avoidance of WPN. Of course, the angle of bend 52 and/or the 6° upward slope may be varied to optimize flow conditions for a given refrigerant in a given system, including bends of 90° or larger. Thus, refrigerant flows through jumper tube 18 into evaporator inlet 54, through evaporator coils 56, and back to compressor 12 (FIG. 1) through evaporator outlet conduit 58.

Figure 4:
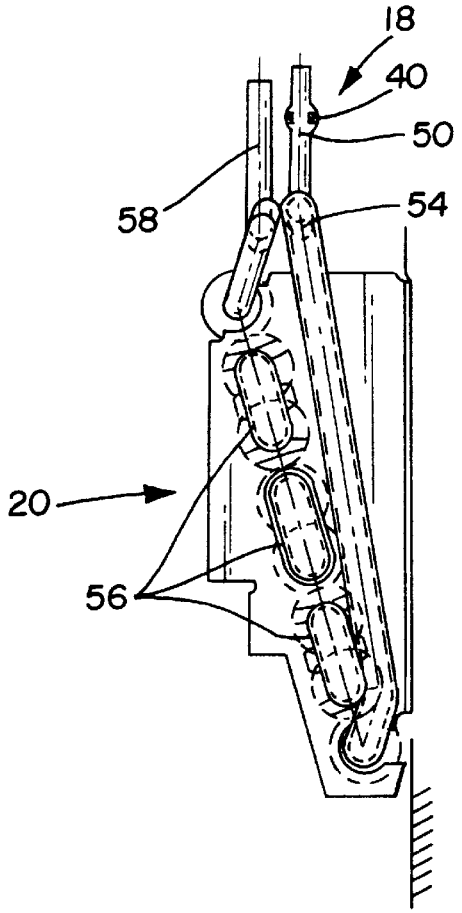
FIG. 4 is side plan view of the evaporator shown in FIG. 3.

FIG. 4 is a side view of the connection of jumper tube 18 to evaporator 20 that allows refrigerant to flow from jumper tube 18 to evaporator coils 56 through evaporator inlet conduit 54 and then back to compressor 12 (FIG. 1) through evaporator outlet conduit 58. From this view, crimped portion 40 of jumper tube 18 is bulb-shaped.

Figure 5:
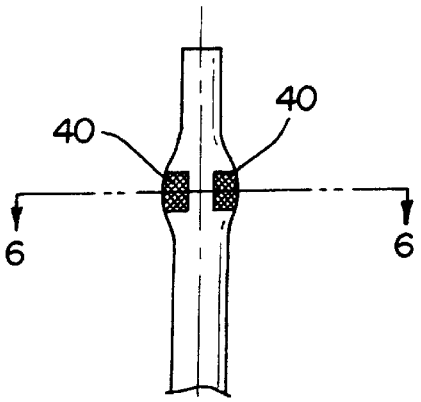
FIG. 5 is a magnified side view of the jumper tube shown in FIG. 2.

FIG. 5 is an enlarged view of jumper tube 18 from the perspective of FIG. 4. As shown in FIG. 5, a portion of jumper tube 18 is outwardly displaced from longitudinal axis 50 at crimped portion 40.

Figure 6:
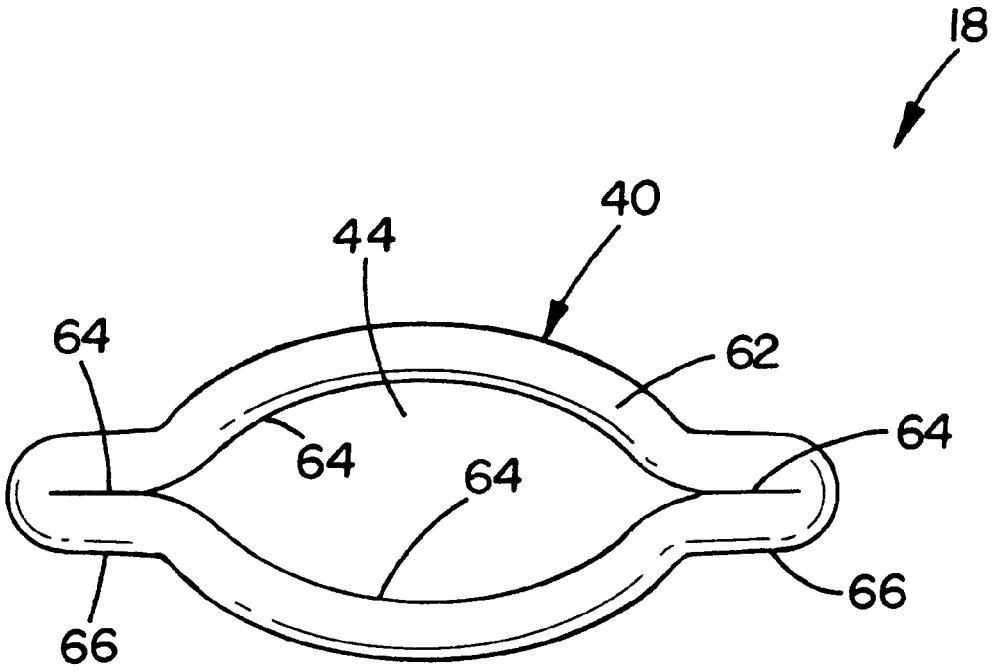
FIG. 6 is a cross sectional view of the jumper tube shown in FIG. 5 taken along line 6—6.

FIG. 6 is a cross-sectional view of crimped portion 40 at section 46 (FIG. 2), showing transition passage 44 formed by crimped sidewall 62 of jumper tube 18. A portion of jumper tube sidewall 62 is folded or crimped on each side of transition passage 44 so that an inner face 64 of sidewall 62 forms transition passage 44 with inner surface 64 of folding sidewalls 66 contacting one another. The contacting inner surface 64 of sidewalls 66 provides transition passage 44 with the shape of a clam shell, i.e., having two substantially arched sections inverted relative to one another and substantially intersecting at the sides of transition passage 44 where folding sidewalls 66 contact one another. The separation of the arched sections, i.e., the height of the passage, is smaller than the inner diameter of capillary tube 16 to form a stop for capillary tube 16, such as a passage height of 0.032 inches to 0.053 inches.

In an exemplary embodiment, jumper tube 18 is fabricated from aluminum, plastic, or a metal, such as copper, and has an inlet portion axial length of about 0.25 inches and a cavity portion 24 axial length of about 0.75 inches. Transition passage 44 has a nominal minimum diameter of about 0.040 inches, slightly larger than the capillary tube inner diameter of approximately 0.026 inches, and much smaller than the capillary tube outer diameter of 0.076 inches. The bend is formed about 1.5 inches from crimped portion 40. Cavity portion is crimped so that crimped portion 40 is located about 1 inch from the inlet portion end of jumper tube 18. Crimped portion 40 is formed manually with a pneumatic hand tool that resembles a pair of scissors with the scissor blades replaced by a pair of appropriately shaped dies that crush jumper tube sidewall 66 to form the clam shell shaped transition passage. Pneumatic hand tools for crimping are well known in the art.

When jumper tube 18 is connected to evaporator 20, capillary tube 16 is inserted into inlet portion 22 and connected to jumper tube 18 by conventional methods, e.g., by soldering or brazing, with deposit materials from the connection process contained in cavity portion 24. Connecting jumper tube 18 to condenser 14 includes the step of inserting capillary tube 16 into jumper tube 18 through inlet portion 22 and into tube cavity portion 24 until capillary tube 16 contacts crimped portion 40 of jumper tube 18. Capillary tube 16 and jumper tube 18 are then joined to form a leakproof joint.

In operation, refrigerant flows downwardly through capillary tube16, and into jumper tube transition portion 28. Refrigerant continuously expands along the jumper tube sidewalls within transition portion 28 and flows downwardly into cylindrical portion 26. A short distance later, refrigerant enters bend section 52 and then flows upward at an angle of about 6° or greater. It is believed that the combination of bend section 52 and the upward turn causes refrigerant to pool in the bottom of the bend and either prevents WPN or affects propagation of WPN by dispersing it or absorbing it so that the noise does not penetrate the sidewalls of jumper tube 18. From bend section 52, refrigerant flows upwardly into evaporator inlet conduit 54.

While the invention has been described in terms of various specific embodiments, those skilled in the art will recognize that the invention can be practiced with modification within the spirit and scope of the claims.

What is claimed is:

1. A jumper tube for a refrigeration system comprising:

a cylindrical portion comprising a cylindrical passage therethrough; and a transition portion comprising a transition passage therethrough and a longitudinal axis, said transition passage in communication with said cylindrical passage and comprising a transition angle to said cylindrical passage of greater than 7° measured from said longitudinal axis.

2. A jumper tube in accordance with claim 1 wherein said transition portion is crimped.

3. A jumper tube in accordance with claim 2 wherein said transition passage comprises a section between a first end and a second end wherein said section has a claim shell shape.

4. A jumper tube in accordance with claim 3 wherein said jumper tube further comprises an inlet portion having an inlet passage, said transition passage at said section is smaller than said inlet passage.

5. A jumper tube in accordance with claim 1 wherein said cylindrical portion further comprises a bend section.

6. A jumper tube in accordance with claim 5 wherein said bend section is an 84° bend.

7. A jumper tube in accordance with claim 1 wherein the refrigeration system includes a capillary tube having an outer diameter, said inlet passage having an inner diameter larger than the capillary tube outer diameter.

8. A refrigerant circuit comprising:

an evaporator; and a jumper tube connected to the evaporator, said jumper tube comprising a longitudinal axis, a transition portion, and a bend section, said transition portion comprising a transition angle of greater than 7° from said longitudinal axis.

9. A refrigerant circuit in accordance with claim 8 wherein said jumper is connected to said evaporator so that refrigerant flows downwardly through said transition portion, and upwardly into said evaporator.

10. A refrigerant circuit in accordance with claim 9 wherein said refrigerant flows upwardly into said evaporator at least approximately at a 6° angle.

11. A refrigerant circuit in accordance with claim 8 wherein said transition portion comprises a transition passage therethrough and a section wherein said transition passage is shaped like a clam shell.

12. A refrigerant circuit in accordance with claim 11 further comprising an inlet portion and an inlet passage therethrough, said transition passage at said section is smaller in cross sectional area than said inlet passage.

13. A refrigerant circuit in accordance with claim 11 wherein said transition portion comprises a sidewall, at least a portion of said sidewall folded upon itself at said section.

14. A refrigerant circuit in accordance with claim 13 wherein said sidewall includes an inner surface, said folded side wall forms a double side wall with said inner surfaces of said folded portion contacting one another.

15. A refrigerant circuit in accordance with claim 8 wherein the refrigeration system includes a capillary tube, the capillary tube including an outer diameter, said first passage having an inner diameter larger than the capillary tube outer diameter.

16. A method for eliminating woodpecker noise in a refrigeration system including a jumper tube for fluidly connecting a condenser to an evaporator, the jumper tube having a cavity portion and a cylindrical portion, said method comprising the steps of:

crimping the jumper tube to form a transition portion separating said cavity portion from said cylindrical portion, said transition portion including a transition angle of more than 7° measured from the longitudinal axis.

17. A method in accordance with claim 16 further comprising the step of forming a bend in the jumper tube.

18. A method in accordance with claim 17 wherein the jumper tube is crimped about 1.5 inches from the bend.

19. A method in accordance with claim 17 wherein said step of connecting the jumper tube comprises the step of connecting the jumper tube at least at about a 6° slope relative to the evaporator.

20. A method in accordance with claim 16 further comprising the steps of:

inserting the capillary tube into the jumper tube cavity portion until the capillary tube contacts the crimped portion of the tube;

joining the capillary tube and the cavity portion to form a leakproof joint; and connecting the jumper tube to the evaporator so that refrigerant flows downwardly through the transition portion and upwardly into the evaporator.

* * * * *